United States Patent [19]

Hart

[11] Patent Number: 4,762,363

[45] Date of Patent: Aug. 9, 1988

[54] EXERCISE CHAIR

[76] Inventor: Victor R. Hart, 156 Camden High St., London NW1 One, England

[21] Appl. No.: 5,440

[22] PCT Filed: May 14, 1986

[86] PCT No.: PCT/GB86/00267

§ 371 Date: Jan. 9, 1987

§ 102(e) Date: Jan. 9, 1987

[87] PCT Pub. No.: WO86/06598

PCT Pub. Date: Nov. 20, 1986

[30] Foreign Application Priority Data

May 14, 1985 [GB] United Kingdom ..... 8512211
Nov. 11, 1985 [GB] United Kingdom ..... 8527761

[51] Int. Cl.[4] ..... A47C 13/00

[52] U.S. Cl. ..... 297/113; 272/72; 297/130

[58] Field of Search ..... 297/118, 130; 272/72, 272/141

[56] References Cited

U.S. PATENT DOCUMENTS 1,750,549 3/1930 Thomson et al. ..... 272/72
1,982,843 12/1934 Traver ..... 272/72
2,131,570 9/1938 Riley ..... 272/72
2,191,698 2/1940 Painter .
2,714,507 8/1955 Goodrich .
3,473,843 10/1969 Hart ..... 297/130

FOREIGN PATENT DOCUMENTS 1133927 11/1968 United Kingdom .
1604931 12/1981 United Kingdom ..... 272/72

*Primary Examiner*—Kenneth J. Dorner
*Assistant Examiner*—Peter R. Brown
*Attorney, Agent, or Firm*—Charles P. Boukus, Jr.

[57] ABSTRACT

A chair which is convertible to an exercise machine comprises a front L-shaped frame member (51) and a substantially straight rear frame member (52) which is pivotable between a vertical position to form a chair and a horizontal position to form an exercise machine.

In the configuration as an exercise machine, the seat (90), which has wheels underneath, slides along the rear frame member (52) as the user pulls on a bar (80) against the force of springs (85, 86). Cross-members (66, 67) serve as foot rests. The bar may be replaced by two spring members (40, FIG. 3) attached to the top of the vertical limbs of the front frame member.

3 Claims, 3 Drawing Sheets

EXERCISE CHAIR

TECHNICAL FIELD

The present invention relates to an exercise chair and more particularly a chair that can be converted into an exercise machine, e.g. a rowing machine.

BACKGROUND ART

There is known from GB No. 1133927 a chair which is convertible to a sculling machine. However, the conversion procedure is relatively complicated and the chair is relatively bulky and does not have an aesthetically pleasing appearance.

DISCLOSURE OF INVENTION

The present invention seeks to provide an exercise chair of pleasing appearance, which comprises only a relatively small number of component parts, and which can readily be converted from one configuration to another.

According to the present invention there is provided a chair which is convertible to an exercise machine characterised in that it comprises a front frame member of generally L-shaped cross-section having a vertical portion and a horizontal portion, and a substantially straight rear frame member which is pivotally connected to the end of the said horizontal portion remote from said vertical portion and is pivotable between a first position in which it constitutes the back of the chair and a second horizontal portion in which it constitutes an extension of said horizontal portion of the front frame member.

BRIEF DESCRIPTION OF DRAWINGS

Preferred embodiments of the present invention will now be described by way of example only with reference to the accompanying drawings, of which.

MODES FOR CARRYING OUT THE INVENTION

Figure 1:
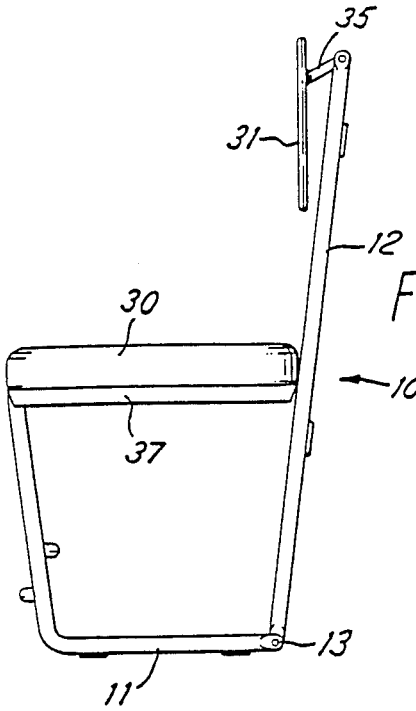
FIG. 1 is a side view of an exercise chair in accordance with a first embodiment of the present invention.
Figure 2:
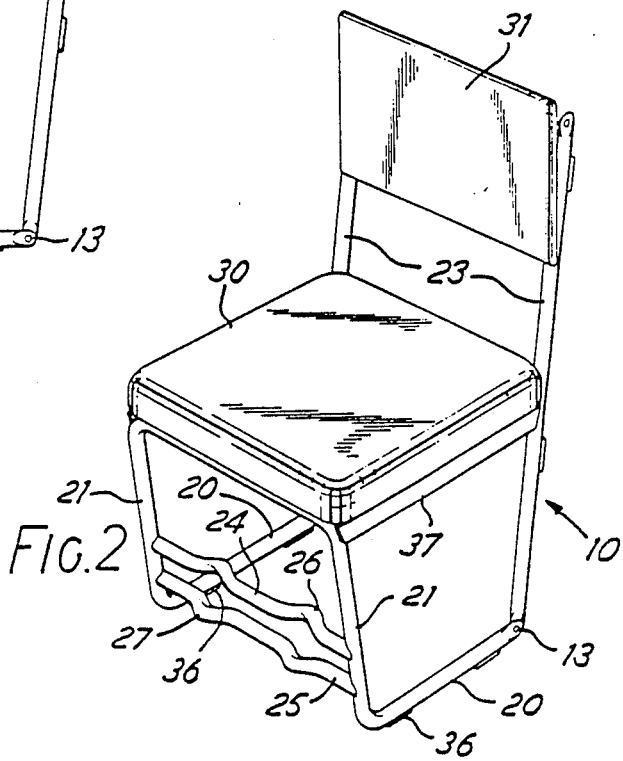
FIG. 2 is a front perspective view of the chair of FIG. 1.
Figure 3:
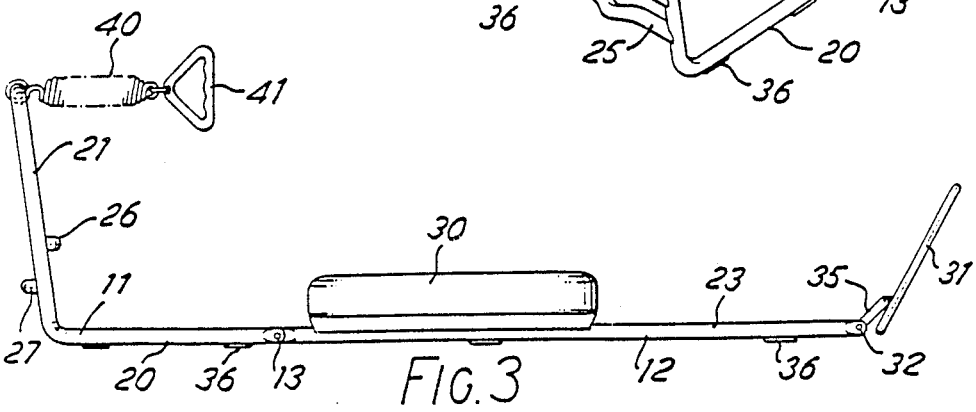
FIG. 3 is a side view of the exercise chair of FIGS. 1 and 2 when opened out into the configuration of a rowing machine.

Referring now to FIGS. 1 to 3 of the drawings, there is shown a chair 10 comprising two relatively-movable frame members 11, 12 connected together by hinges 13. The hinges may be arranged to be locked in an adjusted position. Frame member 11 comprises two parallel horizontal struts 20, two parallel vertical struts 21 and a further horizontal strut (not shown) interconnecting the tops of struts 21 and concealed by seat 30 in use as a chair, FIGS. 1 and 2. Frame member 12 comprises two elongate struts 23 interconnected at an intermediate point by a horizontal strut (not shown) concealed by seat 30 in use as a chair and interconnected at their ends remote from hinges 13 by a horizontal strut 32 located behind back rest 31 in use as a chair. Struts 23 are vertical in normal use as a chair and horizontal in use as a rowing machine, FIG. 3.

Back rest 31 is mounted on struts 32 by means of an arm 35 freely pivotally mounted at both ends.

Seat 30 is attached to the horizontal struts (not shown) of frame 11 and 12, e.g. by a snap-fitting arrangement. This serves to prevent or assist in preventing relative rotation of the frame members. The underside of seat 30 has attachment means for securing in a concealed manner two exercise springs 40 (one of which is shown in FIG. 3). The springs are concealed by side walls 37. The corners of the underside of seat 30 are each provided with a wheel which is grooved or flanged so as to be capable of riding on the rails formed by struts 20 and 23 in the rowing machine configuration of FIG. 3.

Two horizontal struts 24, 25 interconnect the struts 21. Strut 24 has two rearwardly-extending substantially semi-circular loops 26 and strut 25 has two similar forwardly-extending loops 27. The loops are shaped to be comfortable for receiving the feet. Struts 20 and 23 are provided with pads 36 to space them from the floor.

In use, starting from the chair configuration of FIGS. 1 and 2, seat 30 is first detached from the frame members. Frame member 12 is then rotated to its horizontal position shown in FIG. 3 and hinges 13 are locked, when this facility is provided. Back rest 31 is pivoted to its new position shown in FIG. 3. The two exercise springs 40 are then detached from the underside of seat 30 and attached to the tops of struts 21. The wheels on the underside of seat 30 are then placed on struts 20 and 23.

The exercise machine is now ready for use. The user sits on seat 30 with his or her heels resting on the inside (i.e. rear) of loops 27 and toes on the inside (i.e. front) of loops 25. With the arms pulling on handles 41 of springs 40 and with the toes pulling on loops 26, the user moves forward with seat 30 until springs 40 slacken. The user then pushes against loops 27 to move the seat 30 backward and to tension springs 40 again.

When exercise has finished, the chair is assembled by reversing the dismantling process.

An advantage of the above-described embodiment is that the chair is of pleasing appearance when being used as such. The parts used solely in the exercise mode are concealed from view and the parts having a dual role do not appear out of place.

Furthermore the chair comprises only a relatively small number of parts and can quickly be converted from a chair to a rowing machine and back again.

Various modifications may be made to the above-described embodiment. For example the wheels on the underside of the seat can be replaced or supplemented by sets of rollers which may be arranged in inverted channel members secured to the underside of the seat.

In a further preferred modification the springs 40 are permanently attached by their ends to the tops of struts 21; clips (not shown) are conveniently provided for holding the handles 41 against the bottom of the seat 30 during use as chair. This modification has the advantage of further facilitating conversion.

Figure 4:
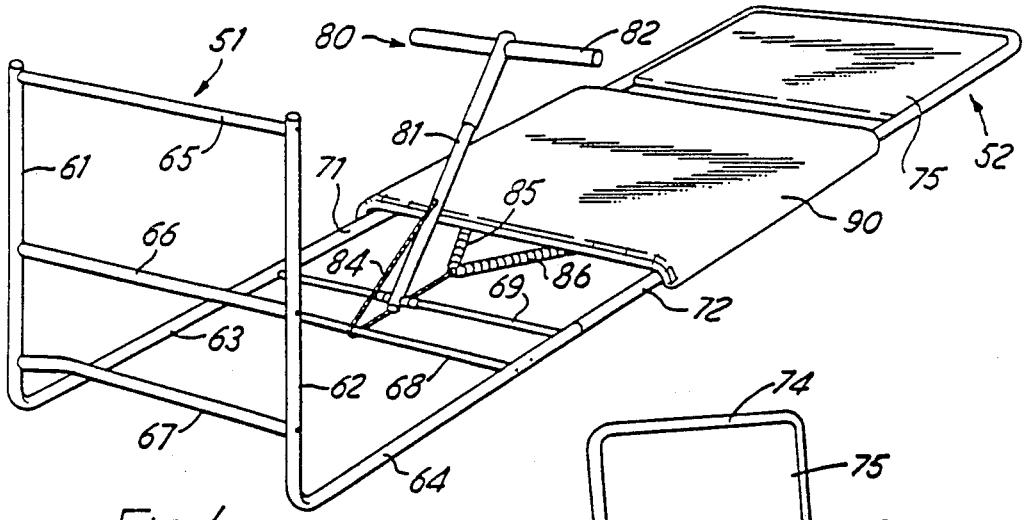
FIG. 4 is a perspective view of an exercise chair in accordance with a second embodiment of the present invention when opened out into the configuration of an exercise machine.
Figure 5:
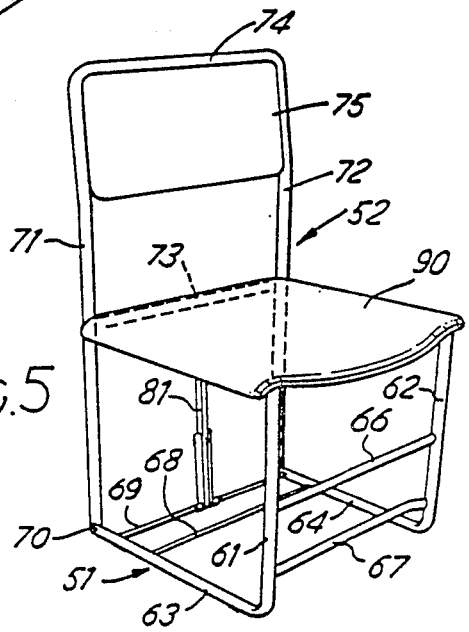
FIG. 5 is a perspective view of the chair of FIG. 4 when reassembled.

Referring now to FIGS. 4 and 5 there is shown an exercise chair 50 comprising two relatively-pivotable frame members 51,52. Frame 51 comprises vertical struts 61,62, horizontal struts 63,64 and horizontal cross-members 65-69. In use as a chair, the front of seat 90 rests on cross-member 65.

Frame 52 is hinged at 70 to frame 51, and comprises two parallel struts 71,72 which are vertical in FIG. 5 and horizontal in FIG. 4. Frame 52 also comprises two horizontal cross-members 73,74 and a fixed back rest 75. In use as a chair, the rear of seat 90 rests on cross-member 73.

Pivotally connected to cross-member 69 of frame 51 is a T-shaped bar 80 having a shaft 81 and a cross-bar 82. Shaft 81 is telescopic and means are provided for locking the parts thereof in an adjusted position.

In use as an exercise machine, seat 90 is arranged to slide on wheels (not shown) over the entire length of struts 71,72 including the parts embracing back rest 75. One end of a rope 84 is attached to an intermediate point along shaft 81. The rope 84 passes around cross-member 68 and is attached to first ends of two coil springs 85,86. The other ends of springs 85,86 are attached to spaced points (not shown) of cross-member 73. Springs 85,86 are preferably 10 cm long.

The user sits on seat 90 and engages his or her feet with cross-members 66,67. Holding the ends of cross-bar 82 he or she then moves backwards and forwards to exercise.

To convert the exercise machine of FIG. 4 into the chair of FIG. 5, seat 90 is removed, frame 52 is pivoted to its vertical position, and seat 90 is then located in position on cross-members 65 and 73. If desired rope 84 and springs 85, 86 may be detached and stowed in storage means on the underside of seat 90; alternatively, to save time, the rope and springs may remain in position. Means may also be provided on the underside of seat 90 for receiving and holding the cross-bar 82 in its FIG. 5 position. This procedure is reversed to obtain the exercise machine again.

The above described arrangement has similar advantages to the exercise chair described in connection with FIGS. 1 to 3. In addition there is the advantage that, in the exercise configuration, the back rest 75 does not limit backward movement and thus the seat 90 can slide along the entire length of frame 52. Furthermore time is saved during conversion, since pivoting of the back rest into its desired position is avoided.

The adjustability of the length of shaft 81 has the advantage of making the apparatus adaptable to be used by people of different heights and arm lengths.

Any of the features of the exercise chair of FIGS. 1 to 3 may replace or modify the corresponding features of the chair of FIGS. 4 and 5 and vice versa. For example the hinges 70 may be lockable, the foot rests 66,67 may be shaped and/or the back rest 75 may be pivotable. If the back rest is not pivotable, special stop elements (not shown) may be provided on the struts 71, 72 and on the underside of seat 90 to prevent the seat sliding off the back of the exercise machine during use.

Figure 6:
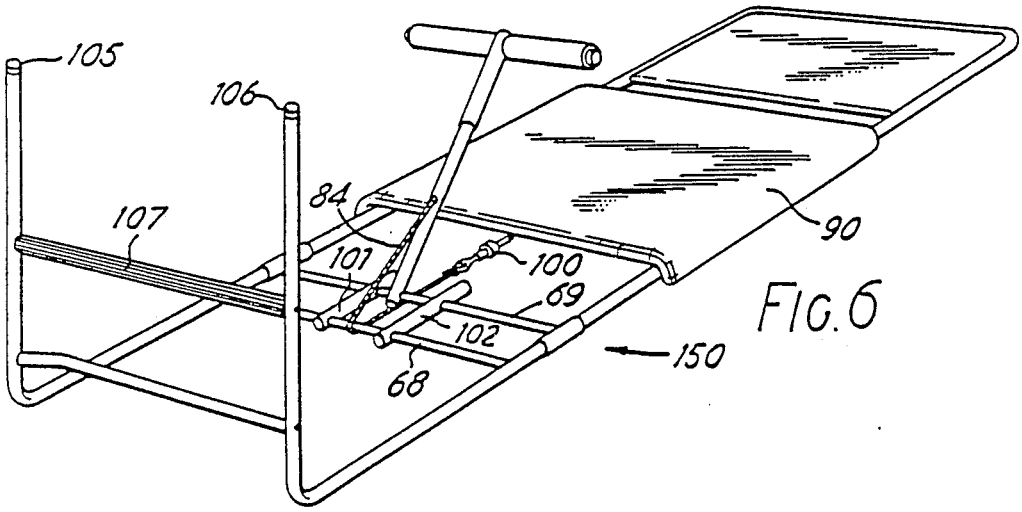
FIG. 6 is a perspective view of an exercise chair which is a modification of the second embodiment, similar to the view of FIG. 4.

In a modified exercise chair 150, FIG. 6, rope 84 is attached to the two springs (85, 86 not shown in FIG. 6) via an adjustment device 100 which permits the tension in the springs to be adjusted. This has the advantage of permitting exercise by a wide range of users and also permits the force necessary to operate the apparatus to be gradually increased as an individual user becomes fitter and stronger.

Two additional bracing bars 101, 102 are provided between cross-members 68,69. In addition cross-member 65 is omitted; instead, when in use as a chair, the front corners of seat 90 rest on stops 105, 106. A grooved rubber or plastics tube 107 is also provided around cross-member 66 to act as a foot grip.

Figure 7:
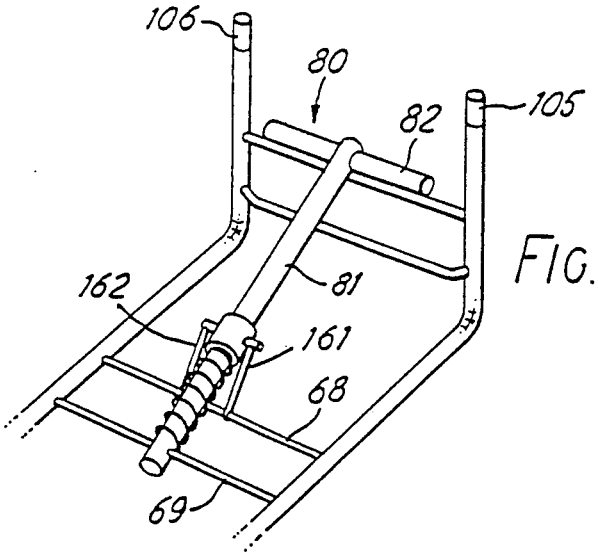
FIG. 7 is a perspective view of part of an alternative modification of the second embodiment.
Figure 8:
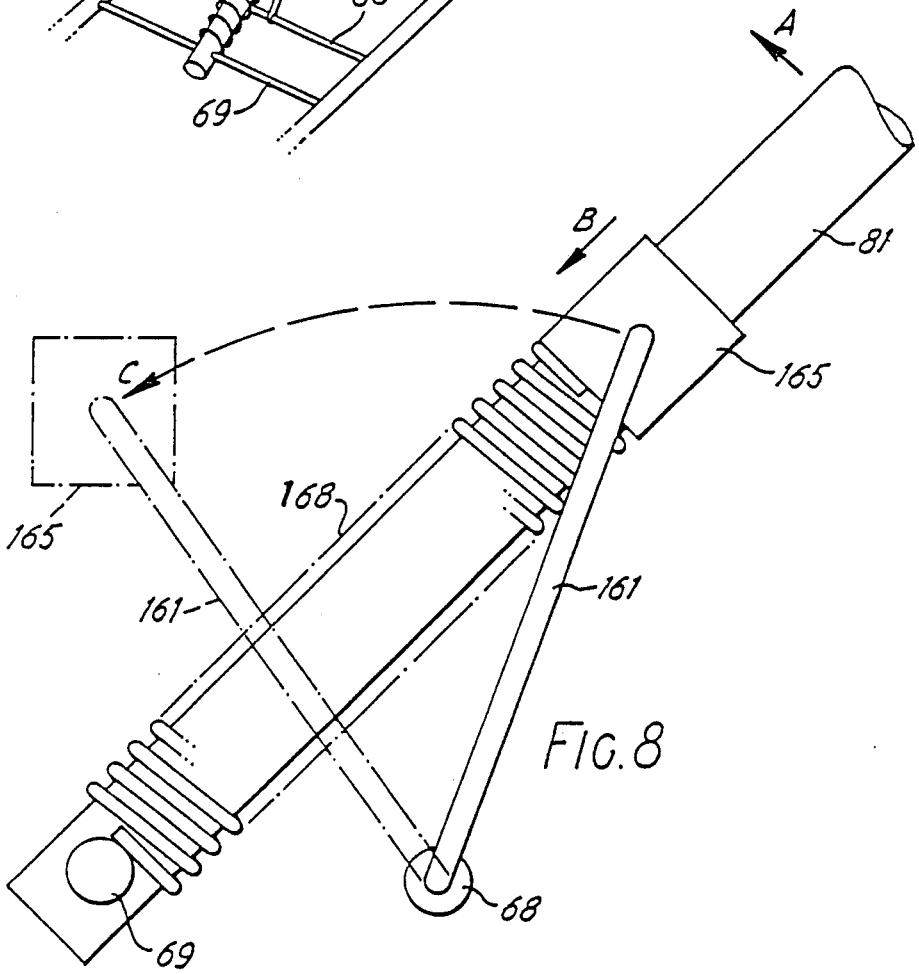
FIG. 8 is an enlarged side view of the modification of FIG. 7.

In another modified exercise chair, FIGS. 7 and 8, the T-shaped bar 80 is stressed in a different manner. The bar itself is pivotally mounted on cross-member 69. The bottom ends of two rods 161, 162 are pivotally connected to cross-member 68. The top ends of the rods are pivotally connected to a sleeve member 165 which is slidably mounted around the shaft 81 of bar 80. A strong compression spring 168 surrounds shaft 81 between the sleeve 165 and cross-member 69.

As the user pulls bar 80 in the direction indicated by arrow A, the rods 161, 162 pull sleeve member 165 down as indicated by arrow B. Spring 168 is compressed and rods 161,162 pivot as indicated by arrow C. Rod 161 and sleeve member 165 then occupy the positions shown in dotted lines in FIG. 8.

Instead of or in addition to springs 40; 85, 86; the pulling means may comprise a hydraulic and/or a pneumatic device.

What is claimed is:

1. An apparatus arranged to rest on a substantially level and horizontal support surface and convertible between a chair configuration and an exercise machine configuration, the apparatus comprising a front frame member of generally L-shaped cross-section having a vertical portion and a horizontal portion substantially perpendicular thereto, a substantially straight rear frame member, said rear frame member being pivotally connected to the end of said horizontal portion remote from said vertical portion, a pull-resistant means and a detachable seat member, wherein, in the chair configuration, said horizontal portion is arranged to engage the horizontal support surface and to constitute the support means for the chair thereon, said rear frame member is pivoted to a first position substantially perpendicular to said horizontal portion and constituting the back of the chair, and said seat member extends parallel to said horizontal portion and is detachably connected to and extends between the upper end of said vertical portion of said front frame member and a point on said rear frame member, and wherein, in the exercise machine configuration, said rear frame member is pivoted relative to said front frame member to a second position constituting an extension of said horizontal portion of said front frame member and said seat member is movably mounted thereon, and one end of said pull-resistant means is attached to one of said frame members, the other end of said pull-resistant means being provided with handle means.

2. An apparatus as claimed in claim 1, wherein said seat member is provided with rolling means, for moving on said rear frame member.

3. An apparatus as claimed in claim 2, wherein said front frame member comprises a pair of spaced vertical and parallel limbs constituting said vertical portion and a pair of spaced horizontal and parallel limbs constituting said horizontal portion and said rear frame member comprises a pair of spaced straight and parallel limbs, wherein spaced first and second cross-members are provided extending between and perpendicular to the limbs of said pairs, and wherein said pull-resistant means comprises a bar and pull-resisting means, said one end of said bar being pivotally attached to said first cross-member and said pull-resisting means being coupled between said bar and said second cross-member.

* * * * *